US005425472A

United States Patent [19]

Covault et al.

[11] Patent Number: 5,425,472

[45] Date of Patent: Jun. 20, 1995

[54] JUG WITH DETACHABLE BUCKLE AND STRAP ASSEMBLY

[75] Inventors: Andrew Covault; Timothy M. Holub, both of Wichita, Kans.

[73] Assignee: The Coleman Company, Inc., Wichita, Kans.

[21] Appl. No.: 967,521

[22] Filed: Nov. 5, 1992

[51] Int. Cl.[6] ..... A45C 11/20

[52] U.S. Cl. ..... 220/754; 220/776; 224/148

[58] Field of Search ..... 220/754, 759, 769, DIG. 10, 220/776; 224/148, 202, 205, 208, 252, 269; 24/301, 302, 199, 683

[56] References Cited

U.S. PATENT DOCUMENTS 231,263 8/1880 Brackebush ..... 220/769 X
239,484 3/1881 Geren ..... 220/769
3,128,905 4/1964 Hesslein ..... 220/776 X
3,290,743 12/1966 Hanson ..... 24/301
3,820,695 6/1974 Pecjak ..... 224/148
5,042,676 8/1991 Gohlke ..... 220/759
5,147,079 9/1992 Heather ..... 224/148

*Primary Examiner*—Steven M. Pollard

[57] ABSTRACT

A jug or container is provided with a buckle and strap assembly which is removably attached to the jug. The jug includes an outer wall with a pair of recesses and a pair of upper and lower attaching lugs within each recess. A buckle is removably attached to each pair of lugs. Each buckle includes an elongated body with upper and lower latches which engage the attaching lugs. Three transverse slots are provided in the body between the latches. A strap is adjustably secured to the buckle by passing through the upper slot, the middle slot, the lower slot, and back through the upper slot.

14 Claims, 3 Drawing Sheets

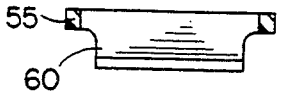
FIG. 11
FIG. 7
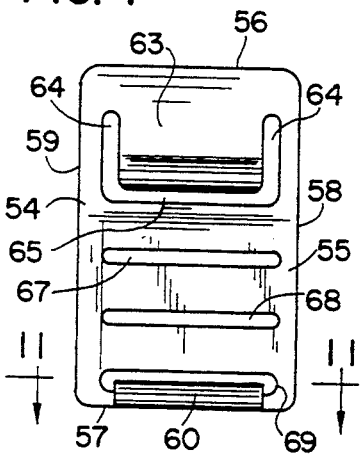
FIG. 9
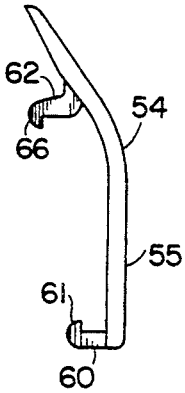
FIG. 10
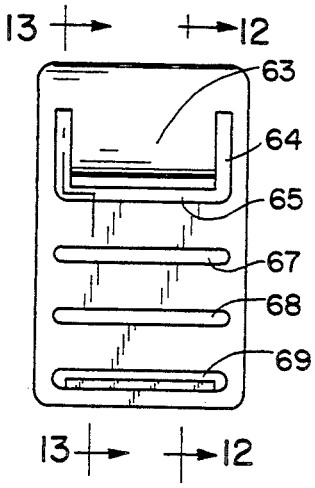
FIG. 14
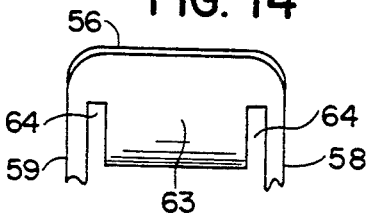
FIG. 8
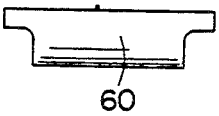
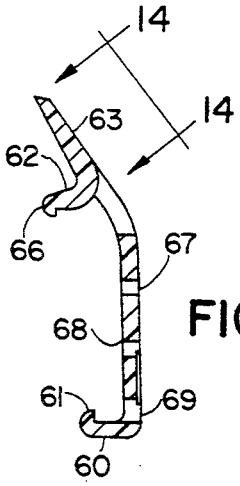
FIG. 13
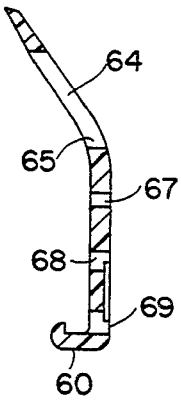
FIG. 12

JUG WITH DETACHABLE BUCKLE AND STRAP ASSEMBLY

BACKGROUND AND SUMMARY

This invention relates to containers such as jugs which are supported by a carrying strap. More particularly, the invention relates to a detachable buckle and strap assembly for a container.

The invention finds particular utility in a jug for holding liquid, and the specific embodiment described herein is a jug. However, it will be understood that the invention can also be used with other containers which are supported by a carrying strap.

Containers such as jugs are often equipped with a carrying strap so that the user can conveniently transport the container by slipping the strap over one shoulder or by holding the strap with one hand. The strap should be adjustable so that the length of the strap can be varied as desired. There may be times when the user does not need the strap, and it is advantageous if the strap can be removed easily.

The invention provides a detachable buckle and strap assembly which easily snaps on and off attaching lugs on the jug. The attaching lugs are located in recesses in the side wall of the jug so that when the buckles are attached, the buckles are substantially flush with the side wall. When the buckles are detached, the lugs do not protrude from the recess beyond the side wall. When the jug is used without the strap, there is little likelihood that the recessed lugs will snag on objects, and the jug has a pleasing appearance. The strap passes through slots in each buckle, and the length of the strap is readily adjustable.

DESCRIPTION OF THE DRAWING

The invention will be explained in conjunction with an illustrative embodiment shown in the accompanying drawing, in which—

FIG. 7 is a front elevational view of one of the buckles;

FIG. 8 is a bottom plan view of the buckle;

FIG. 9 is a side elevational view of the buckle;

FIG. 10 is a rear elevational view of the buckle;

FIG. 11 is a sectional view taken along the line 11—11 of FIG. 10;

FIG. 12 is a sectional view of the buckle taken along the line 12—12 of FIG. 10;

FIG. 13 is a sectional view of the buckle taken along the line 13—13 of FIG. 10; and FIG. 14 is a fragmentary view of the buckle taken along the line 14—14 of FIG. 13.

DESCRIPTION OF SPECIFIC EMBODIMENT

Figure 1:
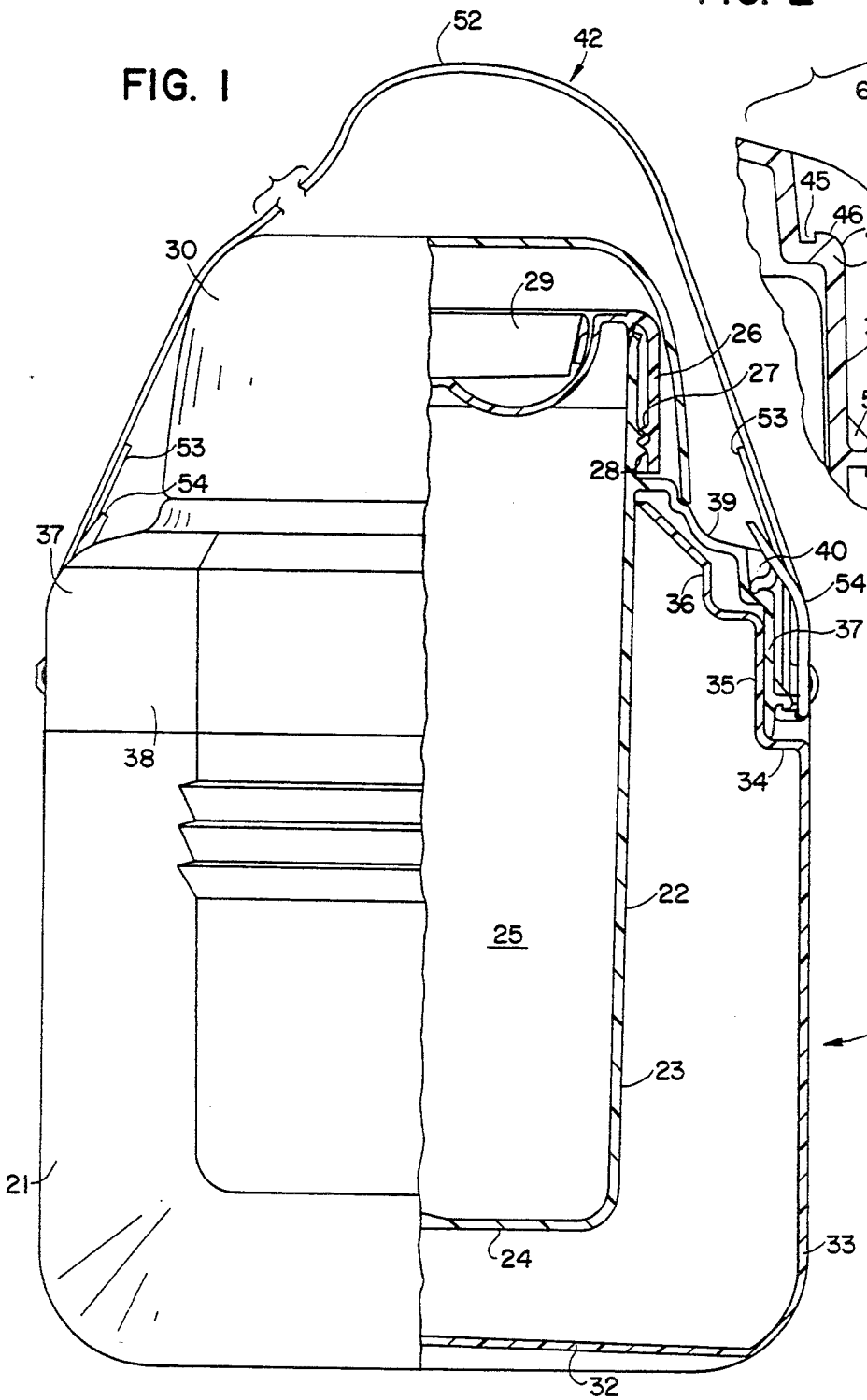
FIG. 1 is a front elevational view, partially broken away, of a jug which is equipped with a detachable buckle and strap assembly in accordance with the invention.

Referring first to FIG. 1, the numeral 20 designates generally a jug for carrying liquids. The particular jug illustrated includes a generally cylindrical base 21 and a liner 22 which fits into the base. The liner includes a generally cylindrical inside wall 23 and a bottom wall 24 which provides an interior chamber 25 for holding liquid.

The open top of the liner is closed by a cap 26. The cap includes internal threads 27 which screw onto external threads 28 on the liner. A conventional pour spout 29 is pivotally mounted in the cap. The spout is shown in its downward or sealing position in FIG. 1. When liquid is to be poured from the jug, the spout is pivoted upwardly to communicate with the liquid chamber 25. The details of such spouts are well known in the jug art and need not be described herein.

A drinking cup 30 is carried on top of the liner 22 and is removably secured to the liner by an internal lug on the cup and an external lug on the liner.

The base 21 includes a bottom wall 32 and a side wall 33. The upper end of the side wall extends radially inwardly to form a horizontal shoulder 34, extends generally upwardly at 35, and then extends inwardly and upwardly at 36 toward the cylindrical wall 23 of the liner.

The liner includes a skirt 37 which extends downwardly over the upper wall portions 36 and 35 of the base and which is supported on the shoulder 34. The skirt includes a generally cylindrical bottom portion 38 and an inwardly and upwardly extending portion 39. As will be explained more fully herein after, the skirt is provided with a pair of diametrically opposed recesses 40. The external surfaces of the skirt and the base merge smoothly at the shoulder 34 except at the recesses.

The space between the base and the liner is filled with conventional insulating polyurethane foam which bonds the base and the liner together. For clarity of illustration, the foam is not shown in FIG. 1. The base is advantageously blow molded from polyethylene, and the liner is injection molded from polypropylene.

Comparing FIGS. 1–4, a strap and buckle assembly 42 is removably attached to the jug within the recesses 40 in the skirt of the liner. Each recess includes upper and lower lugs 43 and 44 which are molded with the liner. The upper lug is formed by a groove 45 in the liner and includes an upwardly extending keeper or hook portion 46. A curved camming surface 47 is provided on the upper end of the keeper portion. The lower lug is generally L-shaped and includes a base portion 48 which extends outwardly from the recessed wall 38 and a downwardly extending keeper or hook portion 49. The keeper portion includes a curved camming surface 50. A pair of triangular reinforcing ribs 51 (FIG. 4) extend between the base portion 48 and the recessed wall 38.

The strap and buckle assembly 42 includes a strap 52 having a pair of ends 53 and a pair of buckles 54. Referring to FIGS. 7–14, each buckle includes an elongated body 55 which includes upper and lower ends 56 and 57 and a pair of sides 58 and 59. An L-shaped lower latch 60 extends outwardly from the lower end. The latch includes a curved camming surface 61.

An L-shaped upper latch 62 extends outwardly from an attaching portion 63 which is joined to the body adjacent the upper end 56. The sides of the attaching portion are separated from the body by longitudinal slots 64, and a transverse slot 54 separates the bottom of the attaching portion and the latch 62 from the body. A camming surface 66 is provided on the end of the latch 62. Three additional transverse slots 67 through 69 are provided in the body between the upper and lower latches. The upper end portion of the body above the slot 65 angles in the direction in which the latches extend. The upper end portion of the body which extends above the upper latch 62 provides a lever arm which facilitates detaching the buckle from the jug.

Figure 2:
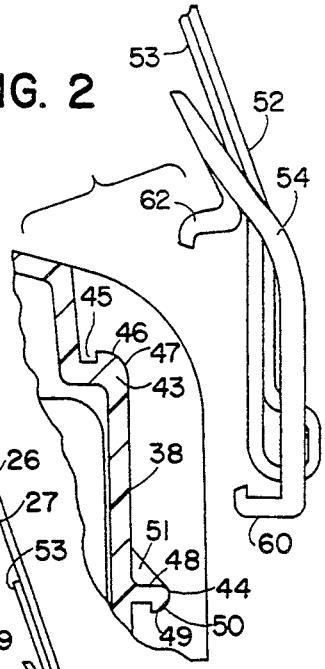
FIG. 2 is a fragmentary exploded view of the jug and the buckle and strap assembly.
Figure 3:
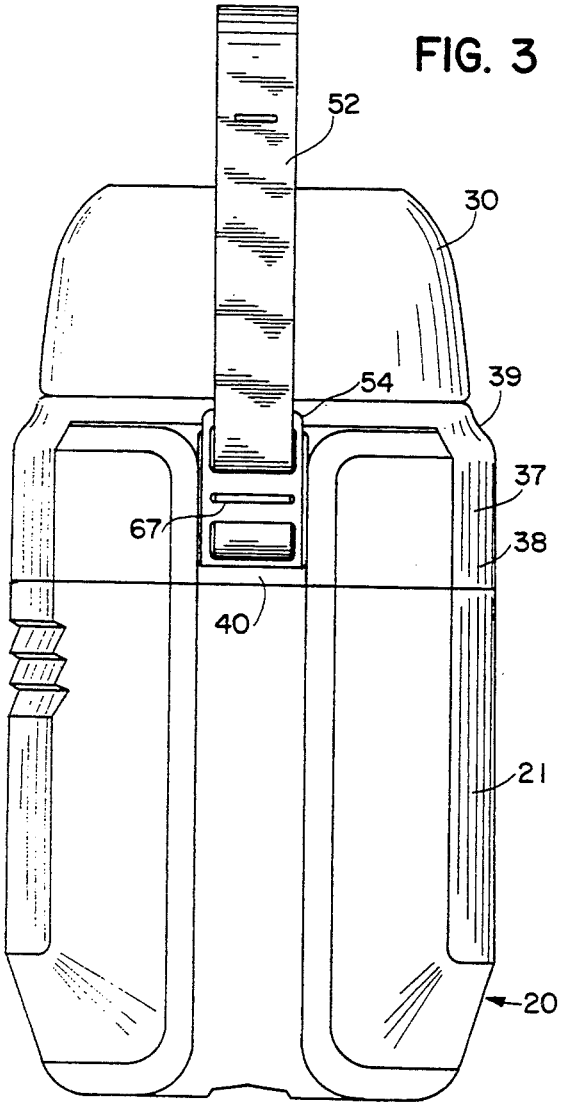
FIG. 3 is a side elevational view of the jug.
Figure 4:
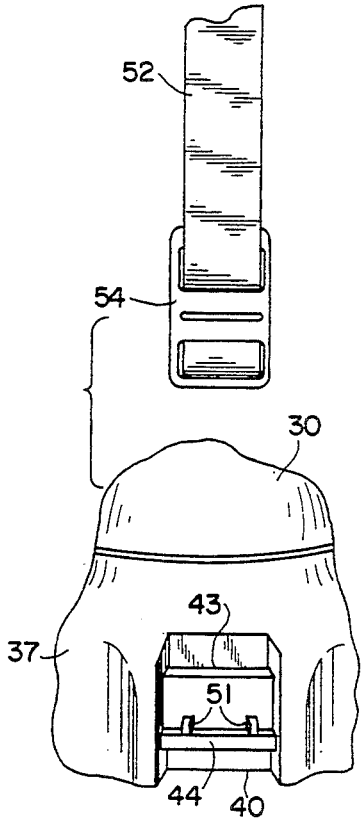
FIG. 4 is a fragmentary side elevational view of the jug with the buckle and strap assembly removed.
Figure 5:
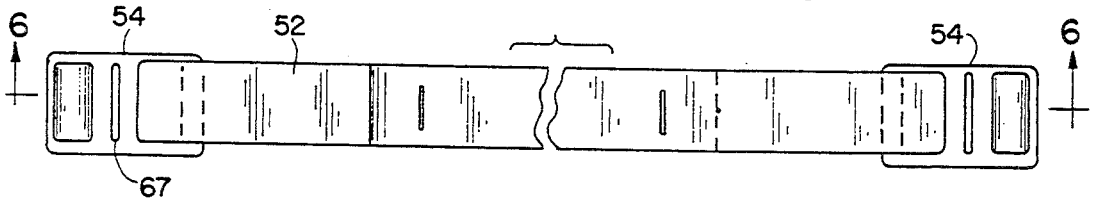
FIG. 5 is a plan view of the buckle and strap assembly.
Figure 6:
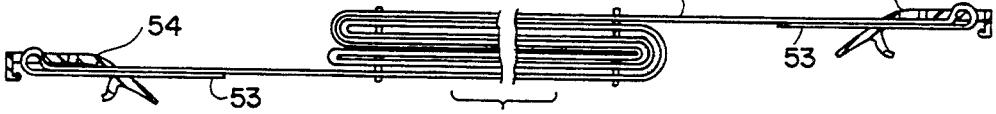
FIG. 6 is a sectional view of the buckle and strap assembly.

Referring to FIGS. 2 and 6, each end of the strap 52 is adjustably secured to one of the buckles by passing the strap through the upper transverse slot 65, through the slot 68, through the lower slot 69, and back through the upper slot 65. The length of the strap is adjusted by varying the length of the end portion which passes back through the upper slot 65.

The buckles are attached to the lugs in the recesses of the jug by first hooking either the lower latch or the upper latch of the buckle over the corresponding lug on the jug. The buckle is then pushed against the jug so that the other latch is cammed over the other lug and snaps into place behind the other lug. The camming surfaces on the latches and the lugs facilitate the camming action. The buckle is formed from flexible and resilient material so that the buckle, and in particular the attaching portion 63, can flex during the attaching step and snap into locking position. In the preferred embodiment the buckle is injection molded from polyester resin which is available under the name Valox 325. The longitudinal slots 64 and the transverse slot 65 facilitate flexing of the attaching portion 63. The other transverse slots 67–69 also increase the flexibility of the buckle. Although the strap is not passed through the slot 67, the strap is visible through the slot 67 and enhances the aesthetic appearance of the strap and buckle assembly.

When the buckles are snapped into locking position within the recesses of the jugs, the exterior surfaces of the buckles are substantially flush with the exterior surface of the skirt 37 (FIG. 1). The jug can be supported by the strap while the jug is carried, and the strap can either be slung over the shoulder of the user or carried by the hand.

When it is desired to remove the strap and buckle assembly from the jug, the upper end 56 of each buckle is pulled outwardly away from the jug. The flexible attaching portion 63 of the buckle flexes to allow the upper latch 62 to move over the upper lug 43 on the jug to release the buckle. The upper end portion of the buckle which extends upwardly beyond the upper latch 62 provides a convenient lever arm to facilitate detaching the buckle from the jug.

If desired, the jug can be used without the strap and buckle assembly. The attaching lugs 43 and 44 are recessed within the recesses 40 and do not protrude beyond the outer surface of the skirt 37 and the side wall 33 of the base. Accordingly, there is little likelihood that the lugs will snag on clothing and other objects. Recessing the lugs also increases the aesthetics of the jug when the jug is used without the strap and buckle assembly.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A jug for holding liquids comprising:

a generally cylindrical container body having a bottom, a generally cylindrical outer wall with a pair of generally diametrically opposed recesses in the outer wall, an internal chamber for holding liquid, and a top opening which communicates with the internal chamber, a pair of upper and lower lugs extending from the outer wall within each of the recesses, the lugs of each pair being spaced apart along the axial direction of the container body, the lower lug of each pair being generally L-shaped and including a base portion which extends outwardly from the wall of the container and a keeper portion which extends downwardly from the base portion, the upper lug of each pair including an upwardly extending keeper portion, a pair of buckles, each buckle releasably engaging one of the pairs of lugs and having an elongated body with upper and lower ends and a pair of sides which extend between the ends and a pair of sides which extend between the ends, a lower latch joined to the body adjacent the lower end thereof, the lower latch being generally L-shaped and including an end portion which extends toward the upper end of the body, an upper latch joined to the body adjacent the upper end thereof, the upper latch including an attaching portion which is joined to the body and a generally L-shaped portion which includes an end portion which extends toward the lower end of the body, the body being provided with a first transverse slot which extends between the sides adjacent the lower latch, a second transverse slot which extends between the sides and which separates the L-shaped portion of the upper latch from the body, and a third transverse slot which extends between the sides intermediate the first and second slots, and an elongated strap having a pair of end portions, each end portion of the strap being adjustably secured to one of the buckles by having the end portion pass through the second slot, through the intermediate slot, through the first slot, and back through the second slot whereby the end portion is adjustably secured to the buckle.

2. The jug of claim 1 in which each of the keeper portions of the lugs includes a camming surface and each of the L-shaped portions of the latches on the buckle includes a camming surface, the camming surfaces being engageable when the buckle is being attached to the lugs.

3. A container and strap assembly comprising:

a container having a wall, a pair of spaced-apart lugs on the wall, one of the lugs being generally L-shaped in cross section and including a base portion which extends outwardly from the wall of the container and a keeper portion which extends generally perpendicularly from the base portion, the other lug being spaced from the said one lug in a direction opposite to the direction in which the keeper portion extends and including a keeper portion which extends in said opposite direction, a buckle having a body portion and a pair of spaced-apart latches on the body portion releasably engaging said lugs, the body portion having plurality of slots between the latches, and a strap extending through said slots for carrying the container.

4. The assembly of claim 3 in which each of said latches on the buckle includes a generally L-shaped portion.

5. The assembly of claim 4 in which one of said latches includes an attaching portion which is joined to said body portion, the L-shaped portion of said one latch being joined to the attaching portion, said buckle being integrally formed from flexible and resilient material whereby the L-shaped portion of said one latch can move relative to the body portion by flexing of the attaching portion.

6. The assembly of claim 5 in which said attaching portion of said one latch is joined to said body portion along a line which extends generally parallel to said slots.

7. The assembly of claim 6 in which said buckle is provided with a pair of slots which extend generally perpendicularly to the line of attachment between said attaching portion and said body portion and which separate the attaching portion from the body portion.

8. The assembly of claim 6 in which said plurality of slots in the body portion include a first slot adjacent said one latch, a second slot adjacent the other latch, and a third slot between the first and second slots, said strap extending through the first slot, through the third slot, through the second slot, and back through the first slot whereby the strap is adjustably secured to the buckle.

9. The assembly of claim 6 in which said body portion includes a lever portion which extends away from said one latch in a direction opposite to the direction in which the other latch is spaced from said one latch whereby the buckle can be removed from the container by moving the lever portion away from the container.

10. The assembly of claim 5 in which each of the L-shaped portions of the latches on the buckle includes a camming surface which is engageable with one of the lugs on the container when the buckle is being attached to the lugs.

11. The assembly of claim 5 in which each of the keeper portions of the lugs includes a camming surface and each of the L-shaped portions of the latches on the buckle includes a camming surface, the camming surfaces being engageable when the buckle is being attached to the lugs.

12. The assembly of claim 3 in which each of the keeper portions of the lugs includes a camming surface which is engageable with one of the latches on the buckle when the buckle is being attached to the lugs.

13. A buckle for releasably retaining a strap comprising:

an elongated body having first and second ends and a pair of longitudinal sides which extend between the ends, a first latch joined to the body adjacent the first end thereof, the first latch being generally L-shaped and including an end portion which extends toward the second end of the body, a second latch joined to the body adjacent the second end thereof, the second latch including an attaching portion which is joined to the body and a generally L-shaped portion which includes an end portion which extends toward the first end of the body, the body being provided with a first transverse slot which extends between the sides adjacent the first latch, a second transverse slot which extends between the sides and which separates the L-shaped portion of the second latch from the body, a pair of longitudinal slots which extend generally perpendicularly from the second slot and which separate the attaching portion of the second latch from the body portion, and a third transverse slot which extends between the sides intermediate the first and second slots.

14. The buckle of claim 13 in which the second end of the body extends angularly away from the remainder of the body to provide a lever portion.

* * * * *